US005458706A

United States Patent [19]

Finck et al.

[11] Patent Number: 5,458,706

[45] Date of Patent: Oct. 17, 1995

[54] SOLID PYROTECHNIC COMPOSITIONS WITH A THERMOPLASTIC BINDER AND A POLYBUTADIENE SILYLFERROCENE PLASTICIZER

[75] Inventors: Bernard Finck, Corbeil; Alain Lefumeux, Orsay; Christian Perotto, Ballancourt, all of France

[73] Assignee: Societe Nationale des Poudres et Explosifs, Cedex, France

[21] Appl. No.: 366,603

[22] Filed: Dec. 29, 1994

[30] Foreign Application Priority Data

Dec. 29, 1993 [FR] France ..... 93 15790

[51] Int. Cl.[6] ..... C06B 45/10

[52] U.S. Cl. ..... 149/19.2; 149/108.8

[58] Field of Search ..... 149/76, 77, 83, 149/87, 19.2, 108.8, 108.2

[56] References Cited

U.S. PATENT DOCUMENTS 3,932,240 1/1976 Braun et al. .
3,954,527 5/1976 Sayles .
4,023,994 5/1977 Arendale .
4,092,188 5/1978 Cohen et al. .
4,097,662 7/1978 Huskins ..... 526/217

FOREIGN PATENT DOCUMENTS 169130 1/1986 European Pat. Off. .
333941 9/1989 European Pat. Off. .
353961 2/1990 European Pat. Off. .
2137619 12/1972 France .
2567895 1/1986 France .

*Primary Examiner*—Donald P. Walsh
*Assistant Examiner*—Anthony R. Chi
*Attorney, Agent, or Firm*—Cushman Darby & Cushman

[57] ABSTRACT

The object of the present invention is novel solid pyrotechnic compositions with a loaded and plasticized thermoplastic binder, which can be used notably as propellants with non-polluting combustion, as propellants with a high combustion rate or as compositions generating non-toxic gases for air-bags.

The plasticizer for the binder comprises a polybutadiene having a number average molecular weight of between 1500 and 7500 and having, added to some of its ethylenic non-saturations, silylferrocene groups.

17 Claims, No Drawings

SOLID PYROTECHNIC COMPOSITIONS WITH A THERMOPLASTIC BINDER AND A POLYBUTADIENE SILYLFERROCENE PLASTICIZER

The present invention concerns novel solid pyrotechnic compositions with a thermoplastic binder and relates to the general field of solid propellants. It concerns more particularly solid propellants whose combustion creates no or scarcely any pollution, particularly those for the acceleration stages of space launchers, solid propellants with a high combustion rate, notably those for accelerator units and anti-tank rockets, and solid propellants generating non-toxic gases for inflatable cushions or bags used for example as a passive protection for survival rafts, toboggans for emergency exits, or in motor vehicles.

There are already in existence, in the state of the art, many solid pyrotechnic compositions with a thermoplastic binder, notably solid propellants. In general, these compositions consist essentially, apart from the thermoplastic binder, of a plasticizer for this binder and loadings, notably oxidizing loadings whether or not associated with reducing loadings according to the intended application.

Apart from these major constituents, these compositions generally contain, in small amounts, additives, for example anti-oxidants, binder/loading adhesion agents and ballistic catalysts.

The patent EP 333 941 describes for example active solid pyrotechnic compositions for propellants. They consist essentially of a syndiotactic 1,2-polybutadiene thermoplastic elastomer binder with a high molecular weight, a plasticizer for this binder such as dioctyl adipate or dioctyl phthalate, reducing loadings such as aluminum and oxidizing loadings such as ammonium perchlorate, octogen and hexogen.

It is also known that ferrocene derivatives can be added to the compositions having a thermoplastic or thermosetting binder for solid propellants, in order to increase the combustion rate.

However, it is also known that ferrocene and the ferrocene derivatives used up till now have a tendency to oxidize and to migrate over time towards the surface of the propellant, and sometimes even to sublimate, as is the case with ferrocene.

U.S. Pat. No. 3,932,240, which mentions that it has not been possible to resolve this problem of migration by the use of polyferrocene molecules of large size, resolves this problem, for compositions with a thermosetting binder, by incorporating, and therefore fixing, the ferrocene derivative in the thermoset cross-linked binder.

The patent FR 2 567 895 affords another solution for compositions with a thermosetting binder by incorporating in the binder a polybutadiene with hydroxyl or carboxyl terminations and including silylferrocene groups grafted onto the skeleton of the polybutadiene by means of its ethylenic non-saturations.

The problem of migration, which notably causes irregularities in combustion, remains untouched with compositions with a thermoplastic binder.

U.S. Pat. No. 4 023 994 does indeed mention the use, in solid propellants with a thermoplastic binder or with a thermosetting binder, of a ferrocene plasticizer with a weight below 400 in order to avoid the loss of ferrocene by sublimation during the manufacture of the propellant and then during its storage, but this method does not eliminate the migration of the ferrocene derivative in the propellant over time.

The patent FR 2 137 619 describes solid pyrotechnic compositions generating non-toxic gases which can be used in the gas generators for air-bags fitted to motor vehicles. They consist essentially of a polyvinyl chloride thermoplastic binder plasticized by means of an alkyl or alkoxyalkyl adipate, sebacate or phthalate, and an oxidizing loading comprising ammonium perchlorate and an alkali metal salt containing no halogen, such as sodium nitrate. Ferric oxide is used as a combustion accelerator. It is well known that ferric oxide does not migrate in the compositions during storage, but its efficacy is very much lower than that of ferrocene derivatives and this utilisation is then to the detriment of the other loadings, since the production of the compositions imposes an upper limit on the amount of loading, whence a loss in efficacy of the compositions.

The object of the present invention is novel solid pyrotechnic compositions affording a particularly advantageous solution to the above-mentioned problem of migration of the ferrocene catalyst in the case of compositions with a thermoplastic binder. These novel compositions consist essentially of a thermoplastic binder, a plasticizer for the binder and loadings, and are characterised in that the plasticizer comprises a polybutadiene with a number average molecular weight lying between 1500 and 7500, and preferably between 1500, or better still 2000, and 5500, and including, added to some (that is to say at least one but not all) of its ethylenic non-saturations, silylferrocene groups.

"Consist essentially" should be taken to mean that the binder, plasticizer and loadings represent overall, by weight, more than 90% of the total weight of the composition, preferably more than 95%, and often even more than 98% or 99% of the total weight of the composition. The other constituents are, preferably, additives, for example anti-oxidants, binder/loading adhesion agents, wetting agents or opacifiers.

The above-mentioned patent FR 2 567 895 describes the synthesis of such polybutadienes, which have hydroxyl or carboxyl terminal groups, and which are then made to react with a polyisocyanate or a polyepoxide so as to integrate this polybutadiene into the cross-linked matrix of a solid propellant, the thermosetting composition of which comprises a conventional plasticizer.

It should be noted that, according to the patent FR 2 567 895, and unlike the function which it fulfils according to our invention, the silylferrocene polybutadiene does not fulfil any plasticizing function in the pyrotechnic composition since it reacts with a cross-linking agent in order to be integrated as a unit of a thermosetting polymer of high weight and plasticized by means of a conventional plasticizer.

This novel function fulfilled according to our invention by the polybutadiene with silylferrocene groups, and therefore the fact that this polybutadiene fulfils the dual function of plasticizer for a thermosetting binder and combustion catalyst, gives rise, unexpectedly, to many particularly interesting advantages.

In the first place, which was particularly sought for, it is found that there is no migration of the silylferrocene polybutadiene towards the surface of the propellant during ageing. This result is particularly unexpected since it is contrary to the known general teachings, notably the aforesaid teachings of U.S. Pat. No. 3,932,240 concerning polyferrocene molecules of large size.

Then a significant reduction in the pressure exponent of the rate of combustion curve as a function of the pressure is noted, that is to say the rate of combustion of these compositions depends less on the pressure prevailing in the combustion chamber, in comparison with the known compositions containing a conventional ferrocene catalyst. This is particularly interesting since, when the rate is broadly dependent on the pressure, on the one hand an accidental increase in the combustion rate, caused for example by a crack, results in an overpressure which may be damaging to the structure of the missile and its equipment, or to the walls and filters of the generator in the case of gas generators, and on the other hand, in the case of gas generators for air-bags, there may occur, at the time of inflation of the bag, in the combustion chamber directly connected to the bag, a pressure drop which then causes an appreciable and undesirable reduction in the combustion rate, which may even, in extreme cases, cause the composition to be extinguished.

An increase in the combustion rate is also noted, for an identical iron content, that is to say a better efficacy as a combustion catalyst, compared with conventional ferrocene catalysts.

These findings relating to the pressure exponent and to the combustion rate are all the more surprising since the aforementioned patent FR 2 567 835 indicates that, when this same polybutadiene with silylferrocene groups is integrated into a thermosetting binder, the characteristics of the combustion of these compositions, from the point of view of both the combustion rate and the pressure exponent, are the same as those of the propellants of the prior art, for an equivalent iron content afforded by the addition of a conventional combustion catalyst.

A reduction in the burning time (ignition time) of the compositions is also noted, compared with the compositions without a silylferrocene polybutadiene plasticizer. Because of this, the stable combustion state is reached after a shorter transient ignition phase and the mechanical stresses imposed at the moment of firing are lower. In addition, in the case of gas generators for air-bags fitted to motor vehicles, this makes it possible to reduce the time required as from the detection of the impact to the complete inflation of the bag.

Excellent physical compatibility is also found between the thermoplastic binder and the polybutadiene with silylferrocene groups. Because of this, it is possible to incorporate relatively high quantities of this polybutadiene in the binder, up to 100% in relative parts by weight in certain cases, which makes it possible on the one hand to modify the iron content of the compositions very easily and to a large extent, and on the other hand to utilise no other plasticizer, whence a considerable simplification of use.

Greater safety in use or storage of these compositions at high temperatures is also noted since, unlike the use of conventional ferrocene derivatives which reduces the decomposition temperature of ammonium perchlorate and/or increases its sensitivity to impact and friction, the use of the ferrocene polybutadiene according to the invention has only very little effect on these parameters.

The polybutadienes including silylferrocene groups used within the scope of the present invention may be synthesised as described in the aforesaid patent FR 2 567 895 from polybutadienes of number average molecular weight in general between 1000 and 5000 and preferably between 1500 and 3500, and having for example hydroxyl, carboxyl or ethylenic terminations. Polybutadienes having a proportion of vinyl non-saturations of around 20% are particularly preferred.

According to the present invention, the polybutadiene with silylferrocene groups, which, it should be stated, does not participate in any chemical condensation reaction and is therefore used as a plasticizer for the thermoplastic binder rather than as a constituent of the binder, is in general a liquid which is viscous at room temperature (approximately 20° C.) and preferably has on the one hand non-saturations of the vinyl type carried by carbon atoms constituting the chain of the polybutadiene, and on the other hand ethylenic, hydroxyl or carboxyl terminal groups, preferably hydroxyl. In a preferred manner, the silylferrocene groups are added to 15% to 60% of the non-saturations of the vinyl type and to less than 3% of the other ethylenic non-saturations of the polybutadiene.

As a general rule, the iron content by weight of the polybutadiene having silylferrocene groups is between 3% and 15%.

The silylferrocene groups preferably comply with general formula (I):

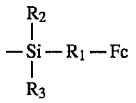

in which:

Fc represents a ferrocene dichloropentadienyl group, where at least one of the two rings may be substituted, for example, by an alkyl chain such as methyl, ethyl, propyl, butyl, pentyl, hexyl, heptyl or octyl. Fc preferably represents ferrocene dicyclopentadienyl, $R_1$ represents an aliphatic chain, substituted or otherwise, or an aromatic chain, substituted or otherwise, preferably a methylenic chain, substituted or otherwise, or a phenylene, benzylidene or benzylene radical. Highly preferably, $R_1$ represents a methylenic chain of formula $(CH_2)_n$ in which n is an integer such that $1 \leqq n \leqq 6$, $R_2$ and $R_3$, identical or different, represent an aliphatic chain, substituted or otherwise, an aromatic chain, substituted or otherwise, or an $—R_1—Fc$ group. Preferably, $R_2$ and $R_3$ are alkyl groups, preferably $C_1$ to $C_4$, for example the methyl group or ethyl group, or the group $-[R_1-(C_5H_4)Fe(C_5H_5)]$.

According to a variant of the invention, the plasticizer consists solely of such a polybutadiene, or a mixture of such polybutadienes.

According to another variant, the plasticizer also comprises one or more conventional plasticizers, inert or active. Examples of such conventional plasticizers would be alkyl phthalates and notably dioctyl phthalate, alkyl adipates such as dioctyl adipate, sebacates, butylbenzene sulphonamide (BBS), polyisobutylenes (PIB) of number average molecular weight between 2000 and 4000, and bis(2,2-dinitropropyl) formal.

According to a preferred variant of the invention, the thermoplastic binder has a number average molecular weight of between 10,000 and 300,000, preferably between 10,000 and 100,000 and even better between 10,000 and 30,000.

Examples of suitable thermoplastic binders would be vinyl polyacetals, vinyl polybutyrals, vinyl polyformals, vinyl polyacetates, cellulose acetobutyrate, cellulose acetopropionate, vinyl polychlorides, vinyl polychloride/vinyl acetate, vinylidene polychlorides, polyoxyethylenes, polyoxymethylenes, polyoxypropylenes, polyacrylates, polymethacrylates, polybutylenes, polycarbonates, polychloroethers, vinyl/ethylene polychlorides, polyethers, vinyl polyethylene/acetate, polyethylene/acrylate, polyalphamethylstyrenes, polystyrenes, polystyrene/butadiene, polystyrene/isoprene/styrene and polystyrene/butadiene/ styrene.

Amongst thermoplastic binders, preference is given particularly to thermoplastic elastomers, that is to say thermoplastic binders possessing elastic properties and keeping them at low temperature, down to approximately −50° C., and more particularly still, notably in the case of compositions for non-polluting propellants or for non-toxic gas generators for air-bags, oxygenated thermoplastic elastomers, that is to say thermoplastic elastomers in which at least one of the repeating monomeric units of the elastic polymer comprises at least one oxygen atom. It was found, particularly in the case of non-toxic gas generators, that under these conditions a much better mechanical strength of the charges disposed inside these generators was obtained, at all temperatures of use, compared with the use of thermoplastic binders such as vinyl polychloride. The capacity to absorb stresses such as vibration and shaking is considerably increased. A reduction in the carbon monoxide content of the combustion gases was also found, which is particularly interesting because of the toxicity of this gas.

Amongst the thermoplastic elastomer binders, block copolymers are preferred, consisting principally of blocks with elastomeric flexible units which give the binder the required elasticity, and blocks with hard units, which give the binder the necessary mechanical properties. Experts are aware of many blocks with flexible units or hard units. Examples of blocks with flexible units would be polyether blocks, polyisoprene blocks, polyacetate blocks and polybutadiene blocks, and examples of blocks with hard units would be polystyrene blocks, polyamide blocks, polyacrylate blocks, polymethacrylate blocks and polycarbonate blocks.

The relative proportions of blocks with flexible units and blocks with hard units may be variable.

In the case of block copolymer oxygenated thermoplastic elastomer binders, block aliphatic copolymers are particularly preferred, consisting mainly of blocks with polyether units and blocks with polyamide units. The polyether units are for example obtained by the condensation of glycol polyalkylenes and the polyamide units are for example obtained by the condensation of an alkanedioic acid with an alkanediamine.

The block aliphatic copolymers which would be particularly preferred would be those where the polyether blocks are obtained by the condensation of tetramethylene glycol and where the polyamide blocks are obtained by the condensation of dodecanedioic acid with 1,12-dodecanediamine. Such block aliphatic copolymers are for example sold by the company ATOCHEM under the trade-mark PEBAX®. They have a number average molecular weight of around 20,000. Several qualities differ depending on the relative proportions of the polyether blocks and polyamide blocks.

According to another variant of the invention, the thermoplastic binder and the plasticizer represent in total between 8% and 25% by weight and preferably between 12% and 15% by weight of the total weight of the composition, and the loadings represent in total between 75% and 92% by weight and preferably between 85% and 88% by weight of the total weight of the composition. According to another variant, the plasticizer represents between 10% and 60% by weight and preferably between 35% and 45% by weight of the total weight of the binder and plasticizer. According to another variant, the polybutadiene having silylferrocene groups represents between 10% and 100% by weight and preferably between 60% and 100% by weight of the total weight of plasticizer (in the extreme case of 100%, the composition therefore includes no plasticizer other than polybutadiene). All the abovementioned percentage ranges should be understood as including the limits mentioned.

According to another variant of the invention, the loadings are a mixture of at least one oxidizing loading with at least one reducing loading.

When the compositions according to the invention are propellants with non-polluting combustion, that is to say not generating any hydrochloric acid, the reducing loading is preferably aluminum and the oxidizing loading preferably chosen from the group consisting of ammonium nitrate, alkali metal chlorates or perchlorates, triaminoguanidine nitrate, alkaline earth metal nitrates, mixtures of ammonium perchlorate and an alkali metal nitrate, and mixtures thereof, that is to say any mixture of at least two of the aforesaid compounds or mixtures.

When the compositions according to the invention are propellants with a high combustion rate, above 20–50 mm/s at 20 MPa, the oxidizing loading is preferably ammonium perchlorate or a mixture of ammonium perchlorate with octogen and/or hexogen, and the reducing loading is preferably aluminum.

According to another variant of the invention, the loadings are essentially oxidizing loadings preferably comprising ammonium perchlorate optionally in a mixture with octogen and/or hexogen. This is the case, for example, with fast propellants with reduced fumes (without particles).

According to another variant of the invention, when the compositions are solid propellants generating non-toxic gases for inflatable cushions or bags fitted in particular to motor vehicles, the loadings are essentially oxidizing loadings comprising ammonium perchlorate and an alkali metal nitrate preferably chosen from the group consisting of sodium nitrate, which is particularly preferred, potassium nitrate, and mixtures thereof. The adverb "essentially" signifies the possible presence, in small quantities (less than 5% by weight or even better less than 2% by weight of the total weight of the loadings) of non-oxidizing additives in powder form such as carbon black. This variant excludes the presence of reducing metals in powder form such as aluminum because they are liable to constitute incandescent solid residues which may be entrained by the combustion gas and could be harmful to the air-bag and for the passengers in the vehicle.

Still according to this variant, the ammonium perchlorate and alkali metal nitrate represent overall, preferably, from 80% to 100% by weight of the total weight of the oxidizing loadings, or better still 100% by weight, that is to say, in the latter case, the loading of the composition consists solely of ammonium perchlorate and alkali metal nitrate, except, of course, for any additives mentioned above and any impurities which may be present in the substances.

When the composition contains other oxidizing loadings, these are for example ammonium nitrate or triaminoguanidine nitrate.

In general terms, a molar excess of alkali metal nitrate with respect to the ammonium perchlorate is used, for example a molar excess of 1.1 and 1.4.

The formulation and formation of the compositions according to the invention may be effected, continuously or in batches, in a mixer/extruder in accordance with techniques well known to experts, with or without solvent.

When the process is carried out without solvent, the melting of the binder when hot is used to effect the coating of the loadings with this binder. In a mixer/extruder which is heated, generally to a temperature of between 80° C. and 130° C., the binder and plasticizer are introduced, and then the loadings and any additives are added. After mixing, the paste obtained is extruded to the required geometry and is left to cool to room temperature.

In this way particles, strands or small blocks of composition according to the invention are obtained.

When the process is carried out with solvent, first of all the binder is dissolved using a suitable solvent. The solvent for the binder must not dissolve or chemically attack the loadings or any additives. As a solvent, use will advantageously be made of alcohols such as ethanol, propanol and butanol, ketones such as, for example, methyl ethyl ketone, light hydrocarbons such as paraffin and benzene, or chlorinated or fluorinated hydrocarbons such as methylene chloride, trichloroethylene, perchloroethylene, trichlorofluoromethane and monochlorodifluoromethane.

The plasticizer, loadings and any additives are then added. After a homogeneous paste has been obtained, this paste is extruded to the required geometry, and then the solvent is driven off by means of light heating and/or reduced pressure.

This variant with solvent is particularly recommended when the binder has a high melting point, at which the plasticizer or loadings are no longer stable.

With the products thus obtained, the pyrotechnic charge for a gas generator is easily formed, either as a bulk particle charge or as a bundle of elongate strands, or as a block having a geometry suited to that of the generator combustion chamber.

Blocks of propellants for diverse purposes, for example, propellants with non-polluting combustion or rapid combustion, are just as easily formed.

The following non-limitative examples illustrate the invention and the advantages which it affords.

EXAMPLES 1 TO 3

Solid Pyrotechnic Compositions with a Block Aliphatic Copolymer Binder, Generating Non-toxic Gases for Air-bags

Example 1

An Annular Block of 8 g was produced, using the technique without solvent in a mixer/extruder heated to 120° C., having the following composition:

Binder: PEBAX® resin grade 2533, containing approximately 20% polyamide blocks and approximately 80% polyether blocks: 7.82 parts by weight Butylbenzinesulphonamide (plasticizer): 1.64 parts by weight Polybutadiene with hydroxyl terminations and silylferrocene groups, of the theoretical formula:

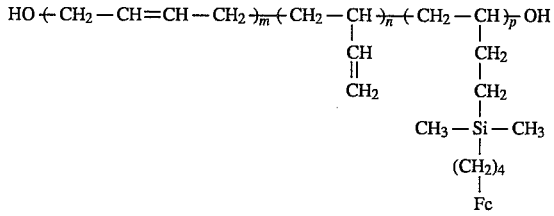

in which Fc represents $(C_5H_4)Fe(C_5H_5)$, sold by the Société Nationale des Poudres et Explosifs under the trade name BUTACENE®, in which the iron content is 8% and the number average molecular weight is around 5000, obtained from

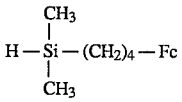

and a polybutadiene with hydroxyl terminations with a number average molecular weight of around 3000 and having approximately 20% vinyl non-saturations: 3.16 parts by weight Binder/loading adhesion agent aminoacrylonitrile: 0.12 parts by weight Lecithin (wetting agent): 0.12 parts by weight Phenolic antioxidant: 0.14 parts by weight Ammonium perchlorate: 47.4 parts by weight Sodium nitrate: 39.6 parts by weight.

The iron content in the composition is 0.253% by weight.

The combustion rate curve as a function of pressure was determined, using the "Strand burner" method well known to experts. The rate, at a pressure of 20 MPa, is 20 mm/s and the pressure exponent 0.40.

The pressure curve as a function of time was also determined, using a manometric bomb test. The burning time is defined as the time required to reach a pressure of 3 MPa. This time is 31 ms.

The CO content of the combustion gases was also assessed by burning the block in a gas generator. Corrected to a useful volume of 2.7 $m^3$, which is the standard volume of a motor car passenger compartment, a content of 47 ppm is obtained.

Example 2

As in Example 1, a block of identical geometry was produced, having the following composition:

The PEBAX® binder used for Example 1: 7.10 parts by weight

Dioctyl phthalate (plasticizer): 0.76 parts by weight

The polybutadiene with silylferrocene groups used for Example 1: 4.44 parts by weight The antioxidant used for Example 1: 0.38 parts by weight The binder/loading adhesion agent used for Example 1: 0.30 parts by weight Carbon black (opacifier): 0.02 parts by weight Sodium nitrate: 43.5 parts by weight Ammonium perchlorate: 43.5 parts by weight The iron content of the composition is 0.36% by weight.

The same determinations were carried out as for Example 1. The results are as follows:

Combustion rate at 20 MPa: 45 mm/s

Pressure exponent: 0.37

Burning time: 27 ms

CO content: 24 ppm

Example 3

As in Examples 1 and 2, a block of the same geometry was produced, having the following composition:

The PEBAX® binder used for Examples 1 and 2: 6.28 parts by weight

The polybutadiene with silylferrocene groups used for Examples 1 and 2: 6.28 parts by weight The antioxidant used for Example 1: 0.39 parts by weight Carbon black: 0.05 parts by weight Sodium nitrate: 39.6 parts by weight Ammonium perchlorate: 47.4 parts by weight The iron content of the composition, which does not contain any plasticizer other than the silylferrocene polybutadiene, is 0.51% by weight.

The same determinations were carried out as for Examples 1 and 2. The results are as follows:

Combustion rate at 20 MPa: 50 mm/s

Pressure exponent: 0.37

CO content: 20 ppm

In order to show clearly the advantages of the invention, two comparative examples A and B, not forming part of the invention, were effected in parallel to these Examples 1 to 3, using the same operating method as for Examples 1 to 3, in order to obtain blocks with an identical geometry, having the following composition and characteristics:

Comparative Example A

The PEBAX® binder used for Examples 1 to 3: 7.10 parts by weight

Butylbenzenesulphonamide: 4.44 parts by weight

Dioctyl phthalate: 0.76 parts by weight

The antioxidant used for Example 1: 0.38 parts by weight

Carbon black: 0.02 parts by weight

The binder/loading adhesion agent used for Example 1: 0.30 parts by weight

Ammonium perchlorate: 43.5 parts by weight

Sodium nitrate: 43.5 parts by weight

The iron content of the composition is nil.

Combustion rate at 20 MPa: 15 mm/s

Pressure exponent: 0.35

Burning time: 55 ms

CO content: 53 ppm

Comparative Example B

The PEBAX® binder as for Examples 1 to 3: 7.18 parts by weight

Butylbenzenesulphonamide: 2.35 parts by weight

Dioctyl phthalate: 2.23 parts by weight

Ferric oxide: 0.62 parts by weight

The antioxidant used for Example 1: 0.32 parts by weight

The binder/loading adhesion agent used for Example 1: 0.12 parts by weight

Lecithin: 0.12 parts by weight

Ammonium perchlorate: 47.4 parts by weight

Sodium nitrate: 39.6 parts by weight

The iron content of the composition is 0.43%.

Combustion rate at 20 MPa: 33 mm/s

Pressure exponent: 0.73

It is noted first of all that use of the polybutadiene with silylferrocene groups enables the burning time to be reduced. In addition, the pressure exponent remains constant, whilst it increases considerably when using $Fe_2O_3$. A much greater efficacy, for equal iron contents, with regard to the rate of combustion is also found.

EXAMPLE 4

Solid pyrotechnic composition with a poly(styrene/isoprene/styrene) binder for a propellant with a high combustion rate Using the technique with a solvent (1,1,1-trichloroethane), in a mixer/extruder heated to 50° C., cylindrical strands for Strand Burner were produced, of diameter 10 mm and having the following composition:

Poly(styrene/isoprene/styrene) binder sold by SHELL under the name CARIFLEX® TR 1107: 10.05 parts by weight The polybutadiene with silylferrocene groups used for Examples 1 to 3 : 4.8 parts by weight Ammonium perchlorate: 24 parts by weight Aluminum: 60 parts by weight The binder/loading adhesion agent used for Example 1: 1.05 parts by weight The antioxidant used for Example 1: 0.10 parts by weight The iron content of the composition is 0.39%. At atmospheric pressure, approximately 0.1 MPa, the combustion rate of this composition is 7 mm/s.

Its sensitivity to impact was also determined using the Julius Peters method, well known to experts, as well as its auto-ignition temperature by progressive heating at 5° C. per minute. The following results were obtained:

Sensitivity to impact (CSI): 20 J

Auto-ignition temperature: 240° C.

Several strands were also packed in polyethylene bags, at approximately 20° C. After three months storage, no colouring of the bags was noted, and therefore no migration of the ferrocene derivative towards the surface of the strands.

In order to show clearly the advantages of the invention, a comparative example C not forming part of the invention was effected in parallel with this Example 4, using the same operating method as for Example 4, in order to obtain strands of identical geometry, having the following composition and characteristics:

Comparative Example C

Poly(styrene/isoprene/styrene) binder identical to that of Example 4: 10.5 parts by weight

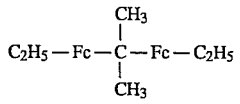

(Catocene®, a common ferrocene combustion catalyst for solid propellants): 1.7 parts by weight Ammonium perchlorate: 23.63 parts by weight Aluminum: 63.02 parts by weight The binder/loading adhesion agent used for Example 4: 1.05 parts by weight The antioxidant used for Example 4: 0.10 parts by weight The iron content of this composition is identical to that of the composition of Example 4 according to the invention, but it is found that the combustion rate, at 0.1 MPa, is only 6 mm/s instead of 7 mm/s as with Example 4. This difference is very great having regard to the low pressure at which these measurements were made.

Using the same methods as for Example 4, on the one hand the sensitivity to impact and the autoignition temperature was measured, and on the other hand strands were stored in polyethylene bags at 20° C.

The sensitivity to impact is 2.6 J and the autoignition temperature is 232° C. It is therefore found that the composition in Example 4 according to the invention is less sensitive than that of this comparative Example C.

Moreover, after two days storage, a yellow colouring of the polyethylene sacks is noted, which then intensifies progressively from day to day, which indicates a rapid migration of the ferrocene catalyst towards the surface of the strands.

Example 5

Solid pyrotechnic composition with poly(styrene/butadiene/styrene) binder for propellants with non-polluting combustion As in Example 4, cylindrical strands of diameter 10 mm were produced, having the following composition:

Poly(styrene/butadiene/styrene) binder sold by SHELL under the name KX 139S®: 8.56 parts by weight The polybutadiene with silylferrocene groups used for Examples 1 to 4: 1.95 parts by weight Dioctyl azelate: 3.17 parts by weight The binder/loading adhesion agent used for Example 1: 0.10 parts by weight The antioxidant used for Example 1: 0.22 parts by weight Ammonium perchlorate: 36 parts by weight Sodium nitrate: 30 parts by weight Aluminum: 20 parts by weight The iron content of the composition is 0.156%. Its combustion rate, at 7 MPa, is 10.5 mm/s, with a pressure exponent of 0.4.

In order to show clearly the advantages of the invention, a comparative Example D not forming part of the invention was effected in parallel with this Example 5, using the same operating method as for Example 5, in order to obtain strands of identical geometry, where the only change with regard to the composition is the replacement of the polybutadiene with silylferrocene groups by an equivalent quantity by weight of poly(styrene/butadiene/styrene) binder.

The iron content of this composition is therefore nil. Its combustion rate, at 7 MPa, is 6 mm/s with a pressure exponent of 0.4.

It is therefore indeed found that, unlike the use of customary ferrocene catalysts, the use of the polybutadiene with silylferrocene groups makes it possible to increase the combustion rate without increasing the pressure exponent.

We claim:

1. Solid pyrotechnic composition consisting essentially of a thermoplastic binder, a plasticizer for the binder and loadings, characterised in that the plasticizer comprises a polybutadiene with a number average molecular weight lying between 1500 and 7500 and including, added to some of its ethylenic non-saturations, silylferrocene groups.

2. Solid pyrotechnic composition according to claim 1, characterised in that the thermoplastic binder is an elastomer.

3. Solid pyrotechnic composition according to claim 2, characterised in that the thermoplastic binder is a block copolymer consisting principally of blocks with flexible units and blocks with hard units.

4. Solid pyrotechnic composition according to claim 2, characterised in that the thermoplastic binder is an oxygenated thermoplastic elastomer.

5. Solid pyrotechnic composition according to claim 4, characterised in that the oxygenated thermoplastic binder is a block aliphatic copolymer consisting principally of polyether units and polyamide units.

6. Solid pyrotechnic composition according to claim 1, characterised in that the polybutadiene includes on the one hand non-saturations of the vinyl type carried by carbon atoms constituting the chain of the polybutadiene, and on the other hand ethylenic, hydroxyl or carboxyl terminal groups, and in that the silylferrocene groups are added to 15% to 60% of the non-saturations of the vinyl type and to less than 3% of the other ethylenic non-saturations of the polybutadiene.

7. Solid pyrotechnic composition according to claim 1, characterised in that iron content by weight of the polybutadiene having silylferrocene groups is between 3% and 15%.

8. Solid pyrotechnic composition according to claim 1, characterised in that the silylferrocene groups comply with general formula

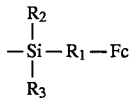

in which:

Fc represents a ferrocene dicyclopentadienyl group, $R_1$ represents an aliphatic chain, substituted or otherwise, or an aromatic chain, substituted or otherwise, $R_2$ and $R_3$, identical or different, represent an aliphatic chain, substituted or otherwise, an aromatic chain, substituted or otherwise, or an - $R_1$ - Fc group.

9. Solid pyrotechnic composition according to claim 1, characterised in that the loadings represent in total between 75% and 92% by weight of the total weight of the composition, in that the thermoplastic binder and the plasticizer represent in total between 8% and 25% by weight of the total weight of the composition, in that the plasticizer represents between 10% and 60% by weight of the total weight of the binder and plasticizer, and in that the polybutadiene having silylferrocene groups represents between 10% and 100% by weight of the total weight of plasticizer.

10. Solid pyrotechnic composition according to claim 1, characterised in that the loadings are essentially oxidizing loadings comprising ammonium perchlorate.

11. Solid pyrotechnic composition according to claim 10, characterised in that the oxidizing loadings also comprise an alkali metal nitrate.

12. Solid pyrotechnic composition according to claim 11, characterised in that the ammonium perchlorate and the alkali metal nitrate represent overall from 80% to 100% by weight of the total weight of the oxidizing loadings.

13. Solid pyrotechnic composition according to claim 11, characterised in that the alkali metal nitrate is chosen from the group consisting of sodium nitrate, potassium nitrate and mixtures thereof.

14. Solid pyrotechnic composition according to claim 10, characterised in that the oxidizing loadings also comprise octogen and/or hexogen.

15. Solid pyrotechnic composition according to claim 1, characterised in that the loadings are a mixture of at least one oxidizing loading with at least one reducing loading.

16. Solid pyrotechnic composition according to claim 15, characterised in that the oxidizing loading is chosen from the group consisting of ammonium nitrate, alkali metal chlorates or perchlorates, triaminoguanidine nitrate, alkaline-earth metal nitrates, mixtures of ammonium perchlorate and an alkali metal nitrate, and mixtures thereof, and in that the reducing loading is aluminum.

17. Solid pyrotechnic composition according to claim 15, characterised in that the oxidizing loading is ammonium perchlorate or a mixture of ammonium perchlorate and octogen and/or hexogen, and in that the reducing loading is aluminum.

* * * * *